US009115923B2

(12) United States Patent
Mitchell

(10) Patent No.: US 9,115,923 B2
(45) Date of Patent: Aug. 25, 2015

(54) SHIELD FOR AN ICE DISPENSING ASSEMBLY OF A COOLING COMPARTMENT

(75) Inventor: Alan Joseph Mitchell, Louisville, KY (US)

(73) Assignee: General Electric Company, Schenectady, NY (US)

( * ) Notice: Subject to any disclaimer, the term of this patent is extended or adjusted under 35 U.S.C. 154(b) by 672 days.

(21) Appl. No.: 13/281,814

(22) Filed: Oct. 26, 2011

(65) Prior Publication Data

US 2013/0104591 A1 May 2, 2013

(51) Int. Cl.

| | |
|---|---|
| ***F25D 3/02*** | (2006.01) |
| ***F25C 5/02*** | (2006.01) |
| ***F25C 5/18*** | (2006.01) |
| ***F25C 5/12*** | (2006.01) |
| ***F25C 5/04*** | (2006.01) |
| *F25C 5/00* | (2006.01) |

(52) U.S. Cl.

CPC . *F25C 5/18* (2013.01); *F25C 5/007* (2013.01); *F25C 5/043* (2013.01); *F25C 5/046* (2013.01); *F25C 5/12* (2013.01); *F25C 5/182* (2013.01); *F25C 5/002* (2013.01)

(58) Field of Classification Search

CPC ..... F25C 2400/04; F25C 5/046; F25C 5/043; F25C 5/12; F25C 5/007; F25C 5/182; F25C 5/002

USPC ..... 62/320, 459, 344

See application file for complete search history.

(56) References Cited

U.S. PATENT DOCUMENTS

| | | | | |
|---|---|---|---|---|
| 134,293 | A * | 12/1872 | Kneisly | 239/650 |
| 4,057,136 | A * | 11/1977 | La Porte, Jr. | 193/3 |
| 6,082,130 | A * | 7/2000 | Pastryk et al. | 62/344 |
| 7,111,473 | B2 * | 9/2006 | Chung et al. | 62/320 |
| 7,870,974 | B2 * | 1/2011 | Miller | 222/108 |
| 2008/0156826 | A1 * | 7/2008 | Kim et al. | 221/258 |
| 2009/0077993 | A1 * | 3/2009 | Kim | 62/344 |
| 2009/0282960 | A1 * | 11/2009 | Kato et al. | 83/403 |
| 2010/0205985 | A1 * | 8/2010 | Chang | 62/137 |
| 2010/0313593 | A1 * | 12/2010 | Lee et al. | 62/320 |

* cited by examiner

*Primary Examiner* — Frantz Jules
*Assistant Examiner* — Steve Tanenbaum
(74) *Attorney, Agent, or Firm* — Dority & Manning, P.A.

(57) ABSTRACT

A shield for an ice dispensing assembly of a cooling compartment. The shield has at least one side member that increases in width along its length downwardly from a top of the shield. The shield blocks ice from falling directly from an ice maker into an ice chute of the cooling compartment.

18 Claims, 6 Drawing Sheets

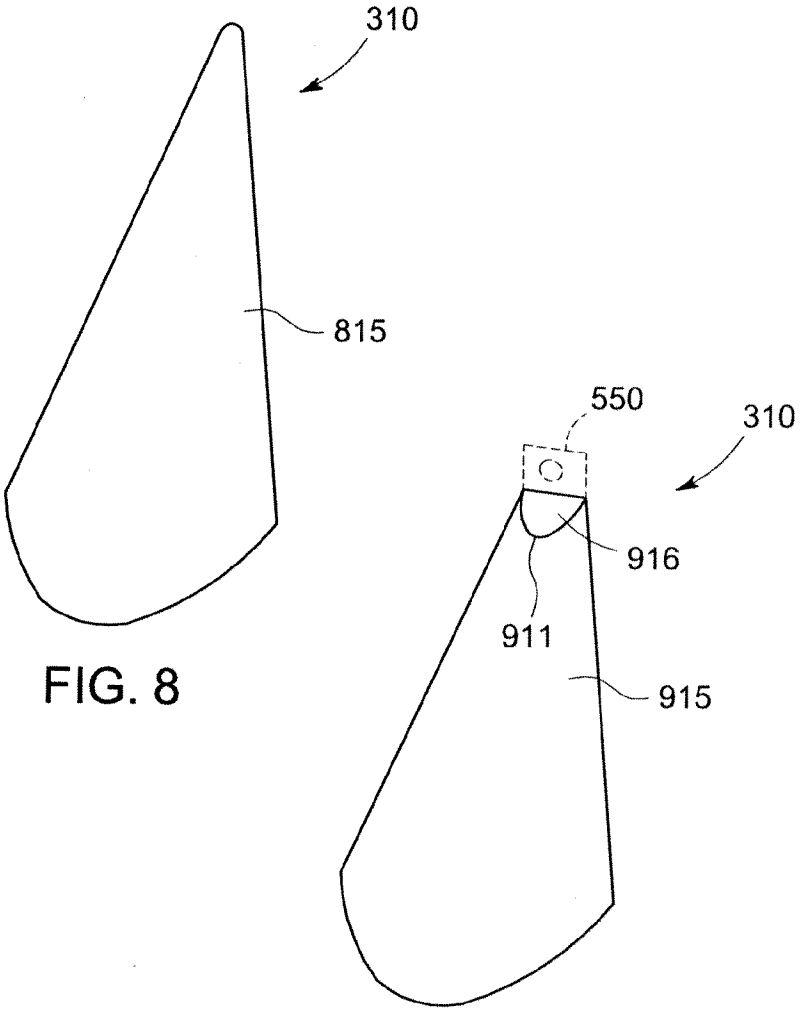
FIG. 8
FIG. 9
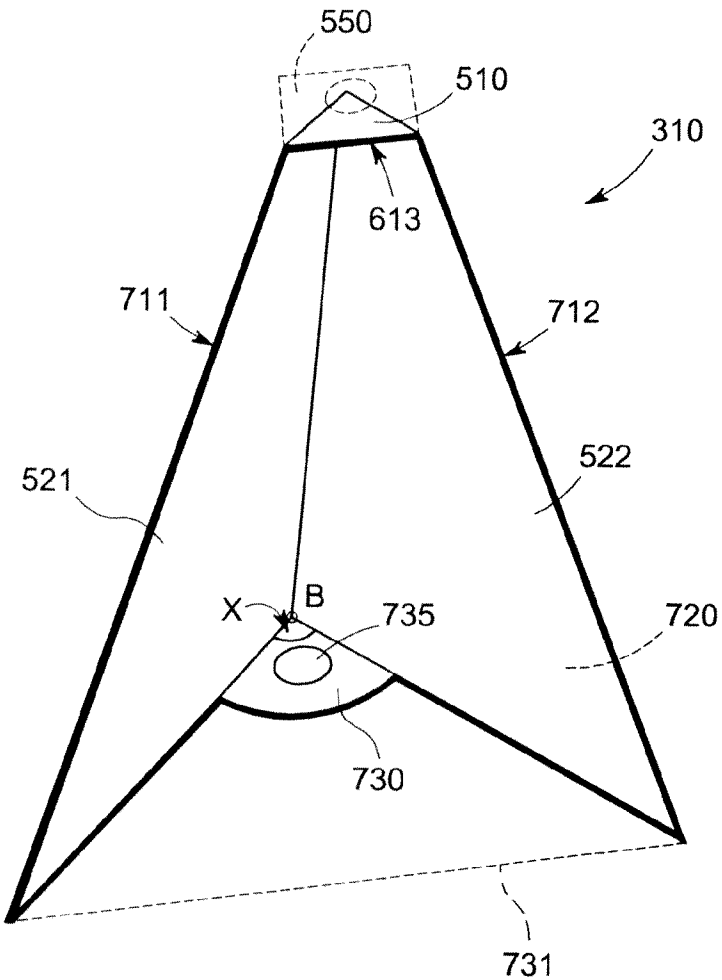
FIG. 7

SHIELD FOR AN ICE DISPENSING ASSEMBLY OF A COOLING COMPARTMENT

BACKGROUND

1. Field of the Invention

The field of the invention relates to cooling appliances generally, and more particularly, to an ice dispensing assembly of a cooling appliance.

2. Related Art

Generally, a cooling appliance includes a fresh food compartment and a freezer compartment which are partitioned from each other to store various foods at low temperatures in appropriate states for a relatively long time.

An ice making system is typically mounted within the freezer compartment. The ice making system makes ice and stores ice cubes in an ice bucket until the ice cubes are requested by a user. The ice cubes are then generally dispensed at an ice dispenser located on an outside door of the freezer compartment.

However, the ice cubes stored in the ice bucket are usually in a relatively stationary state, which can prevent ice delivery through the ice dispenser. For example, the ice cubes in the ice bucket may have formed large clumps of ice since the previous instance of ice dispensing. This creates a problem because stationary and clumped ice cubes cannot readily move through the ice dispensing system for delivery to a user.

FIGS. 10 and 11 illustrate different views of a conventional ice dispensing assembly 10. In ice dispensing assembly 10, ice cubes fall from ice maker 50 into the rectangular ice storage bin 60 and are dispensed via ice chute 30. In order to fall from the ice storage bin 60 to ice chute 30 for dispensing, ice must pass from ice storage bin 60 to the ice crushing region 62.

The bottom surface of conventional ice storage bin 60 is defined by a blade cover or plate 44 and a horizontal or nearly horizontal surface 61 surrounding the plate 44. In a conventional ice dispensing assembly 10, ice cubes can get caught on the horizontal or nearly horizontal surface 61. Attempting to prevent that issue, conventional ice storage bin 60 contains an auger 15. A motor 22 is coupled to the auger 15. Motor 22 is also coupled with blades 20 located in ice crushing region 62 below ice storage bin 60. Plate 44 separates ice storage bin 60 from ice crushing region 62. In conventional ice dispensing assemblies, the cross-sectional area of ice crushing region 62 is smaller than the cross-sectional area of ice storage bin 60.

FIG. 11 illustrates a top perspective view of the conventional ice storage bin 60. It can be seen that when looking down into the conventional ice storage bin 60 from the top, plate 44 is above ice crushing region 62. Ice crushing region 62 has blades 20, so in the conventional system, plate 44 is above blades 20. In FIG. 11, blades 20 are seen through opening 33 of plate 44. As shown, the plate 44 covers a significant area of the bottom surface of ice storage bin 60. Moreover, plate 44 covers most of the surface area of ice crushing region 62, and only a limited portion of ice crushing region 62 is exposed. The progression of ice from ice storage bin 60 to ice crushing region 62 is only possible through opening 33 in plate 44. Therefore, the auger 15 or a similar device is necessary in the conventional ice dispensing assembly 10 in order to break up large clumps of ice and encourage stagnant ice through opening 33 so ice can eventually be dispensed. Auger 15 is vertically disposed within ice storage bin 60 and rotates when motor 22 is energized. Auger 15 is deliberately shaped, for example as illustrated in FIG. 10, to impart downward kinetic energy to ice cubes within ice storage bin 60 as auger 15 rotates.

Conventional ice dispensing assemblies with similar configurations generally work as desired. However, they require motorized components, such as augers, in order to pass ice cubes through a very limited opening at the bottom of an ice storage bin. As a result, the energy efficiency of conventional ice dispensing assemblies with similar configurations is less than desired.

BRIEF SUMMARY OF THE INVENTION

As described herein, the exemplary embodiments of the present invention overcome one or more of the above or other disadvantages known in the art.

An aspect of the present invention relates to a shield that can be part of an ice dispensing assembly of a cooling appliance. The shield has at least one side member that increases in width along its length downwardly from a top of the shield. The shield blocks ice from falling directly from an ice maker into an ice chute. The shield may be positioned in a cooling compartment of the cooling appliance.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures described herein.

BRIEF DESCRIPTION OF THE SEVERAL VIEWS OF THE DRAWINGS

Reference is now made briefly to the accompanying drawings, in which:

FIG. 7 is a perspective view of the inside of a shield in accordance an embodiment;

FIG. 8 is a perspective view of a shield in accordance with another embodiment; and FIG. 9 is a perspective view of a shield in accordance with yet another embodiment.

DETAILED DESCRIPTION

Figure 1:
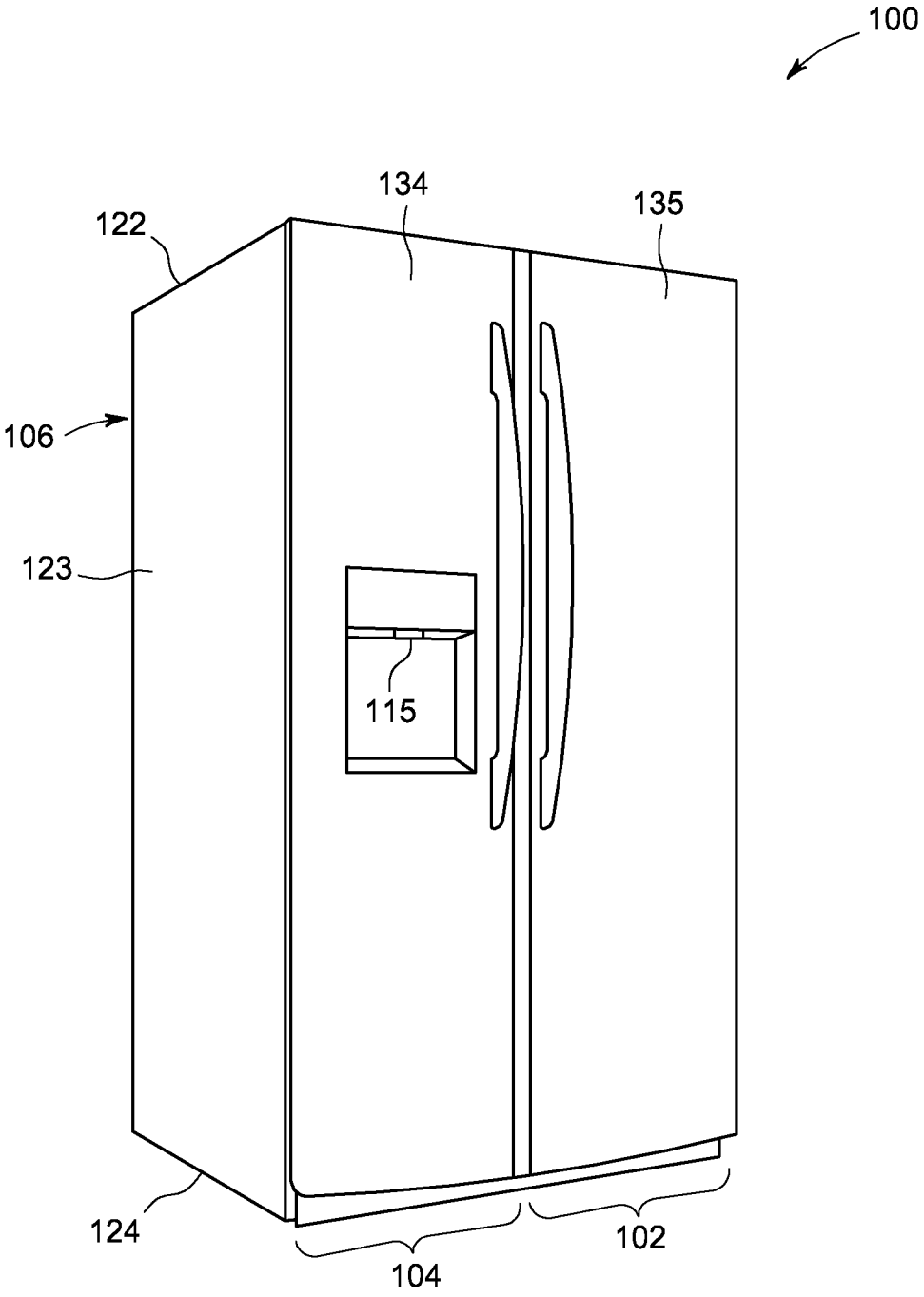
FIG. 1 is an exterior perspective view of a cooling appliance having as an element thereof an embodiment of a shield.
Figure 2:
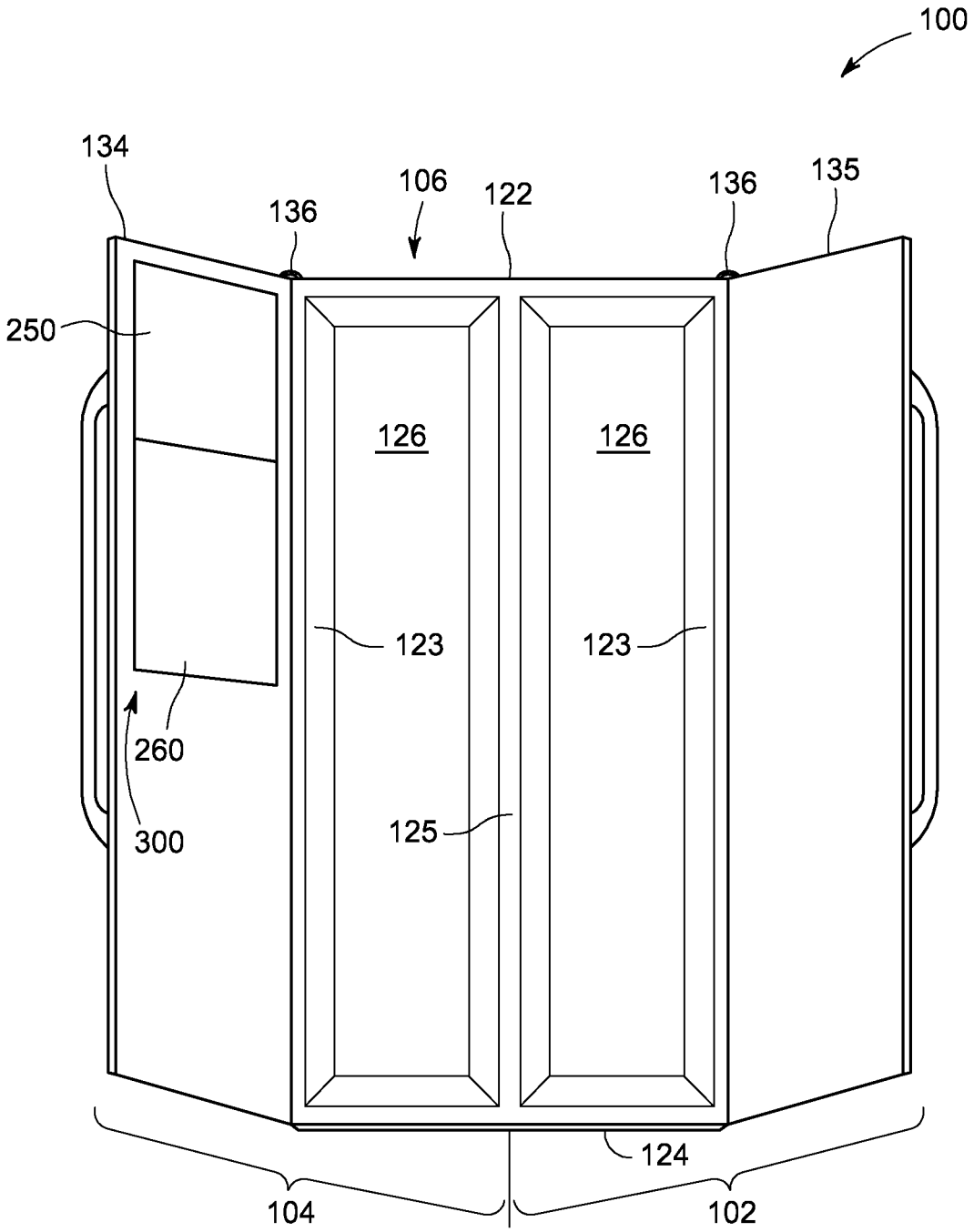
FIG. 2 is a simplified, perspective view of the cooling appliance of FIG. 1 with the access doors of the freezer compartment and fresh food compartment being in their open positions.

FIG. 1 is an exterior perspective view of a cooling appliance 100, comprising a side by side refrigerator/freezer, having as an element thereof an embodiment of an ice shield (hereinafter, "shield"). When implemented as shown and described, the shield blocks ice from falling directly through an opening to an ice chute located inside a compartment 104 formed in a body 106 of the cooling appliance 100. The body 106 of the cooling appliance 100 includes opposing sidewalk 123 coupled with a top wall 122, a bottom wail 124 and a back wail 126 (FIG. 2). The cooling appliance 100 described above is coolable by a conventional vapor compression temperature control circuit (not shown).

In the embodiment of FIG. 1, the freezer compartment 104 and the fresh food compartment 102 are arranged in a side-by-side configuration in the body 106 of the cooling appliance 100. Although the cooling appliance 100 in FIGS. 1 and 2 is shown as the "side-by-side" type, the shield herein described, could be similarly employed in other cooling appliances of different configurations, including but not limited to bottom mount refrigerator/freezers, top mount refrigerator/freezers, stand alone freezers, and the like. Embodiments of the present invention are therefore not intended to be limited to any particular type or configuration of a cooling appliance, except those having an ice dispensing capability, such as but not limited to the ice dispensing assemblies illustratively shown in FIGS. 2, 3, 4A and 4B, and further described below.

Referring again to FIG. 1, the cooling appliance 100 is shown with access doors 134 and 135. Access doors 134 and 135 close frontal access openings of the freezer compartment 104 and fresh food compartment 102, respectively. Access door 134 contains an ice (and optionally, a water) dispenser 115 on the front of the door as shown. Each access door 134, 135 is mounted to the main body 106 by a top hinge 136 (FIG. 2) and corresponding bottom hinge (not shown), thereby being rotatable about its outer vertical edge between a closed position for closing the freezer compartment 104 and fresh food compartment 102, respectively, as shown in FIG. 1, and an open position for accessing the freezer compartment 104 and fresh food compartment 102, respectively, as shown in FIG. 2.

FIG. 2 is a simplified, perspective view of the cooling appliance 100 of FIG. 1 with the access doors 134 and 135 of the freezer compartment 104 and fresh food compartment 102, respectively, being in their open positions. Referring to FIGS. 1 and 2, the main body 106 has a top wall 122 and a bottom wall 124. The top wall 122 connects the two sidewalk 123 to each other at the top edges thereof, and the bottom wall 124 connects the two sidewalk 123 to each other at the bottom edges thereof. A mullion 125 connects the top wall 122 and bottom wall 124 to each other and separates the fresh food compartment 102 from the freezer compartment 104. The main body 106 further comprises a back wall 126 that connects the top wall 122, the two sidewalls 123 and the bottom wall 124. Slide-out drawers, storage bins, and/or shelves not shown are normally located on the back walls 126 of fresh food compartment 102 and freezer compartment 104 to support items being stored therein.

The freezer compartment 104 contains an automatic ice maker 250 positioned proximate and above an ice bucket 260 disposed in and/or on the inside wall of access door 134. Although the ice maker 250 is shown in FIG. 2 as being disposed on access door 134, the teaching of the description is applicable to other configurations of the ice maker 250, including but not limited to, the ice maker 250 being mounted on the top wall 122, side wall 123, and/or back wall 126 of freezer compartment 104. Alternatively, ice maker 250 could be mounted in fresh food compartment 102 and cooled, for example, by providing cooled air from freezer compartment 104 to an area of the ice maker 250 to cool it sufficiently to make ice. Embodiments of the present invention are therefore not intended to be limited to any particular type or configuration of the ice maker 250, although it is most likely that ice maker 250 is proximate and above ice bucket 260 (so that ice cubes can drop directly from ice maker 250 into ice bucket 260), as shown in FIGS. 2 and 3 and further described below.

Figure 3:
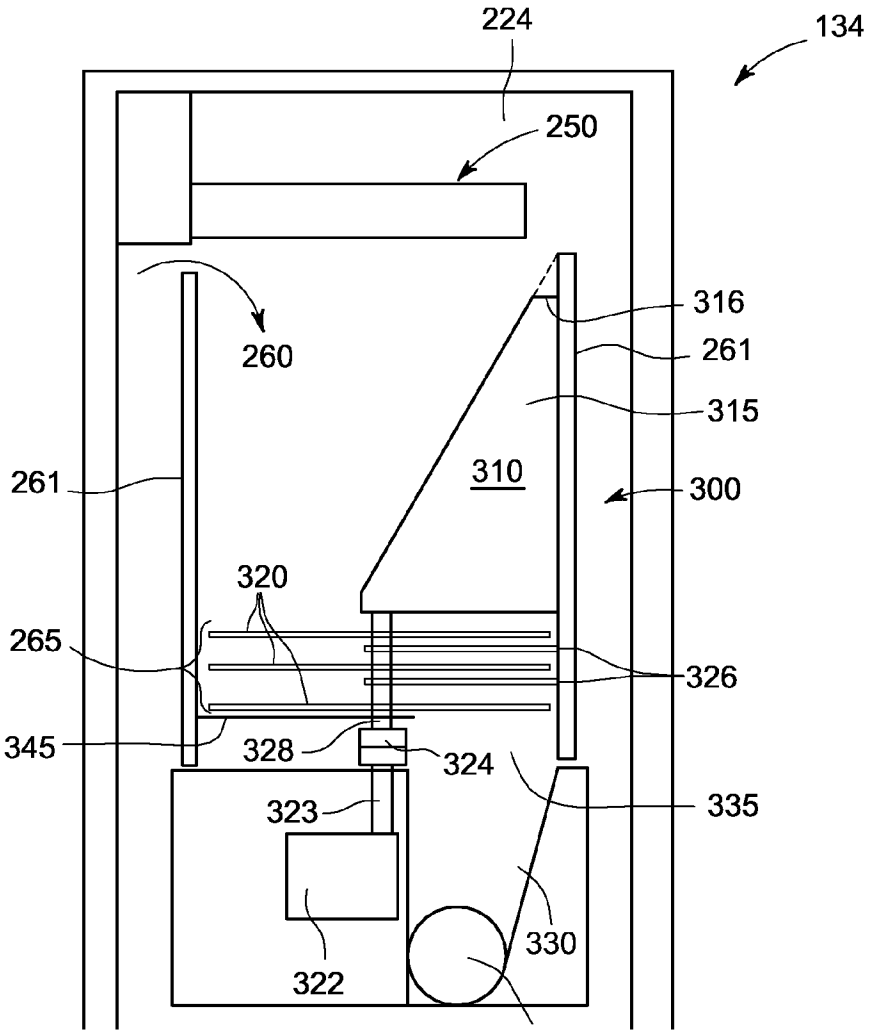
FIG. 3 is a partial, cross-sectional view of the freezer compartment of FIG. 2 in which an embodiment of the shield of FIG. 2 is implemented.

FIG. 3 is a partial, cross-sectional view of a freezer compartment 104 of cooling appliance 100 of FIG. 2, FIG. 3 illustrates how an embodiment of shield 310 is positioned relative to various components of an ice dispensing assembly 300 of a cooling appliance. Ice dispensing assembly 300 is mounted on, removeably coupled with, and/or integrally formed within cooling appliance 100. As shown in FIGS. 2 and 3, ice dispensing assembly 300 is disposed on the inside wall of access door 134 of freezer compartment 104. Alternatively, ice dispensing assembly 300 could be mounted on, removably coupled with, and/or integrally formed within access door 135 of fresh food compartment 102 as well. Accordingly, various options are possible for positioning ice dispensing assembly 300 within cooling appliance 100.

The ice dispensing assembly 300 comprises ice bucket 260 and a shield 310. Ice dispensing assembly 300 may also comprise rotatable blades 320, motor 322, and/or ice chute 330. Ice bucket 260 is mounted on access door 134 such that ice bucket 260 comes into contact with an interior wall 224 of access door 134 inside freezer compartment 104. Alternatively, a portion of the interior wall 224 of access door 134 can serve as a wall of ice bucket 260.

The side walls 261 of ice bucket 260 are configured and positioned so that the ice cubes do not catch on the side walls 261 when they drop from ice maker 250 into bucket 260. In an embodiment, the bottom surface of ice bucket 260 is round. In another, but not necessarily different embodiment, ice bucket 260 is substantially cylindrically shaped. In an embodiment, the bottom surface of ice bucket 260 is stationary plate 345 which is mounted on, removably coupled with, and/or integrally formed within cooling appliance 100. Stationary plate 345 may have a round shape as well. Stationary plate 345 may cover about 80% of the bottom surface of ice bucket 260, and an opening or exit 335 in the stationary plate 345 may comprise approximately the remaining 20%. In an embodiment, ice bucket 260 has an opening 335 which leads to ice chute 330 through which ice cubes must pass in order to be dispensed at ice dispenser 115 (also shown in FIG. 1). In an alternative embodiment where stationary plate 345 is not defined as the bottom surface of ice bucket 260, an opening 335 in stationary plate 345 still leads to ice chute 330 through which ice cubes must pass in order to be dispensed at ice dispenser 115.

In an embodiment, ice bucket 260 also comprises ice crushing region 265, which may comprise rotatable blades 320 and/or crusher blades 326. In that embodiment, stationary plate 345 (and, thus, opening 335) is disposed below ice crushing region 265. The cross-sectional area of ice crushing region 265 is substantially the same as cross-sectional area of ice bucket 260, and the length of the rotatable blades 320 of ice crushing region 265 is nearly equal to the width of ice bucket 260 and or ice crushing region 265. For example, where the cross-section of ice bucket 260 is substantially circular in the ice crushing region 265, the length of rotatable blades 320 is slightly less than or equal to the diameter of the ice bucket 260 (FIGS. 4A and 4B).

A shield 310 is disposed within the ice bucket 260. The shield 310 facilitates ice entry into the ice crushing region 265. Shield 310 is mounted on, removeably coupled with, and/or integrally formed within cooling appliance 100. Shield 310 can be positioned directly over the opening 335 to prevent ice cubes from dropping from ice maker 250 into ice chute 330. The term "directly over" in this context means "higher in position and in line with". This definition of the term "directly over" does not preclude other elements from being disposed in between shield 310 and opening 335. In an embodiment shield 310 is sufficient to cover at least the area of opening 335.

Figure 4A:
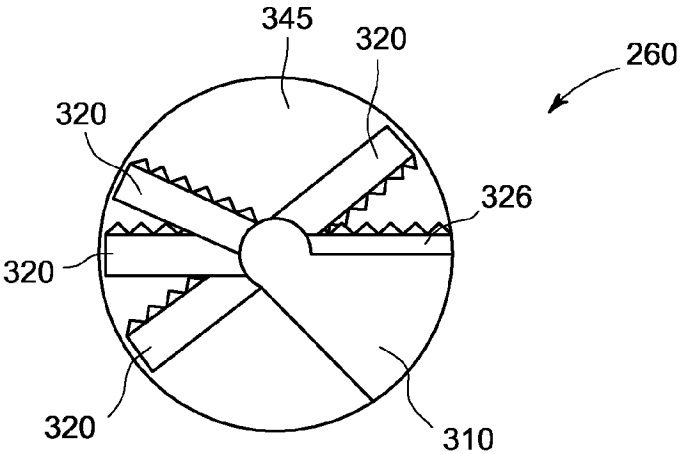
FIG. 4A is a top view of an ice dispensing assembly in accordance with an embodiment having as an element thereof an embodiment of a shield.

FIG. 4A shows an example of shield 310 being sufficient to cover the area of the opening of opening 335. FIG. 4A illustrates a view from the top down looking into a round cross-section of a cylindrical ice bucket 260 of ice dispensing assembly 300 of FIG. 3. As can be seen in FIG. 4A in view of FIG. 3, stationary plate 345 is positioned below blades 320 and 326, and blades 320 and 326 are positioned below shield 310. Shield 310 fits flush with the inner circular wall of ice bucket 260 to prevent ice from catching between shield 310 and the wall 261 (FIG. 3) of ice bucket 260. Opening 335 is not visible in FIG. 4A because the cross sectional area of shield 310 is sufficient to cover at least the area of opening 335 (FIG. 3), which is also the opening in stationary plate 345.

Figure 4B:
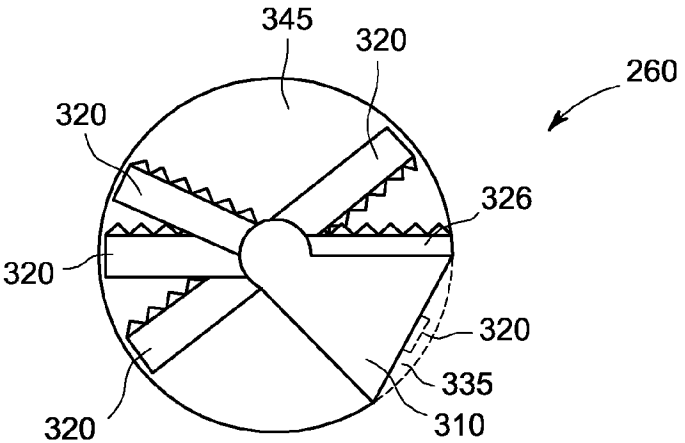
FIG. 4B is a top view of an ice dispensing assembly in accordance with another embodiment having as an element thereof an embodiment of a shield.

FIG. 4B illustrates a view from the top down looking into a round ice bucket 260 of ice dispensing assembly 300 of FIG. 3 in accordance with another embodiment. As can be seen in FIG. 4B in view of FIG. 3, stationary plate 345 is positioned below blades 320 and 326, and blades 320 and 326 are positioned below shield 310. In this embodiment, ice bucket 260 has a truncated edge along the length of shield 310. Along the length of shield 310, the length of the truncated edge varies with and is equal to the width of shield 310. Although ice bucket 260 has a truncated edge along the length of shield 310, the cross-section of ice bucket 260 below the shield 310 may have a round shape to make room for rotatable blades 320.

A portion of opening 335 and a portion of a rotatable blade 320 below shield 310 are illustrated in phantom in FIG. 4B. The phantom illustration is provided for the sake of clarity only. The opening 335 and the portion of the rotatable blade 320 illustrated in phantom in FIG. 413 would not be visible from an actual view from the top down into ice bucket 260. As seen in FIG. 4B, the actual shape of shield 310 may not physically cover the entire area of opening 335. However, opening 335 is not immediately accessible to ice cubes that fall from ice maker 250 because the truncated edge of ice bucket 260 along the length of shield 310 in combination with shield 310 is still sufficient prevent ice from falling directly into opening 335.

Referring back to FIG. 3, shield 310 comprises at least one side member 315. The shape of the at least one side member 310, as viewed from the top down, increases downwardly along the length of shield 310. The shape of the at least one side member 315 can include but is not limited to triangular, trapezoidal, and/or curved. In embodiments with at least two side members 315, the at least two side members 315 can be, but are not required to be identical in shape, width, and/or length.

In one embodiment of FIG. 3, FIG. 3 illustrates an embodiment where the shield 310 comprises two trapezoidal side members 315, FIG. 3 also illustrates an alternative embodiment in which the shield 310 comprises two triangular side members 315. The top portion of one of the triangular side members 315 is illustrated in phantom. In the cases of triangular or trapezoidal side members 315, the two side members 315 share an edge along the length of the side members 315 and meet along that edge at an angle. In the embodiment comprising two trapezoidal side members 315, the shield 310 additionally comprises top member 316. The top member 316 shares an edge with the at least one side member 315. In other embodiments, for example, those respectively illustrated in FIGS. 8 and 9, the shield 310 comprises at least one curved side member 815 and 915. In FIG. 9, shield 310 also comprises a top member 916; the top member 916 shares an edge 911 with the at least one side member 915. The overall shape of shield 310 can vary as long as the shape of shield 310 is sufficient to cover at least an area of opening 335 to prevent ice cubes from falling directly from ice maker 250 into ice chute 330. In embodiment shield 310 further comprises a base member (not shown in FIG. 3).

Turning back to FIG. 3, the passage of ice cubes through ice dispensing assembly 300 is now explained. Ice cubes produced in ice maker 250, are discharged from ice maker 250 into ice bucket 260. Ice cubes may fall directly on rotatable blades 320 and within the gaps formed by rotatable blades 320. As such, ice cubes may fall directly onto plate 345. However, ice is prevented from reaching and falling through opening 335 because shield 310 covers the area of opening 335 and deflects ice away from falling through to that opening. Additionally, ice is also prevented from catching on shield 310 at least because the at least one side surface 315 of shield 310 is steep enough so that ice cubes that hit shield 310 can slide down the at least one side surface 315 and can effectively fill ice bucket 260. The combination of the shield 310 with the straight walls of ice bucket 260 allows clumped ice to fall downwards by gravity into ice crushing region 265 without getting caught on horizontal surfaces, such as those found in conventional ice dispensing assemblies. For at least these reasons, an auger is unnecessary in embodiments of the present invention.

Referring to FIGS. 1, 2 and 3, ice cubes are stored in ice bucket 260 until ice cubes are requested, which can be accomplished by, but is not limited to, a user pressing a button and/or pushing a latch located at ice dispenser 115 located on the body 106 of cooling appliance 100. Motor 322 is actuated by the request for ice cubes. The actuation of motor 322 drives the rotation of drive shaft 323, which, through coupling mechanism 324, drives the rotation of shaft 328. The rotation of shaft 328 causes rotatable blades 320 to rotate therewith.

During operation, the rotational direction of rotatable blades 320 indicates if ice cubes are crushed before dispensing or if they are dispensed as whole ice cubes. For example, when rotatable blades 320 are rotated in a first direction (for example, counterclockwise), ice cubes then driven by rotatable blades 320 into stationary crusher blades 326. Rotatable blades 320 rotate past stationary crusher blades 326. The driving force of rotatable blades 320 traps ice cubes against stationary crusher blades 326 and ultimately crushes ice cubes. After being sufficiently crushed, ice cubes can pass from the region of stationary crusher blades 326 to opening 335. Alternatively, for example, when rotatable blades 320 are rotated in a second direction (for example, clockwise), ice cubes are swept directly to opening 335 and no crushing occurs.

Once at opening 335, ice cubes fall through ice chute 330 to ice dispenser 115, which dispenses the whole or crushed ice cubes through access door 134.

Although FIG. 3 illustrates rotatable blades 320 as having three blades and stationary crusher blades 326 as having two blades, the numbers of rotatable blades 320 and stationary crusher blades 326 are not limited by this illustration. Moreover, as shown in FIGS. 4A and 4B, rotatable blades 320 may have a rigid, sharp, and/or grooved outer surface to assist with grabbing and pushing ice cubes. Similarly, stationary crusher blades 326 may also have a rigid, sharp, and/or grooved surface on either or both sides.

Figure 5:
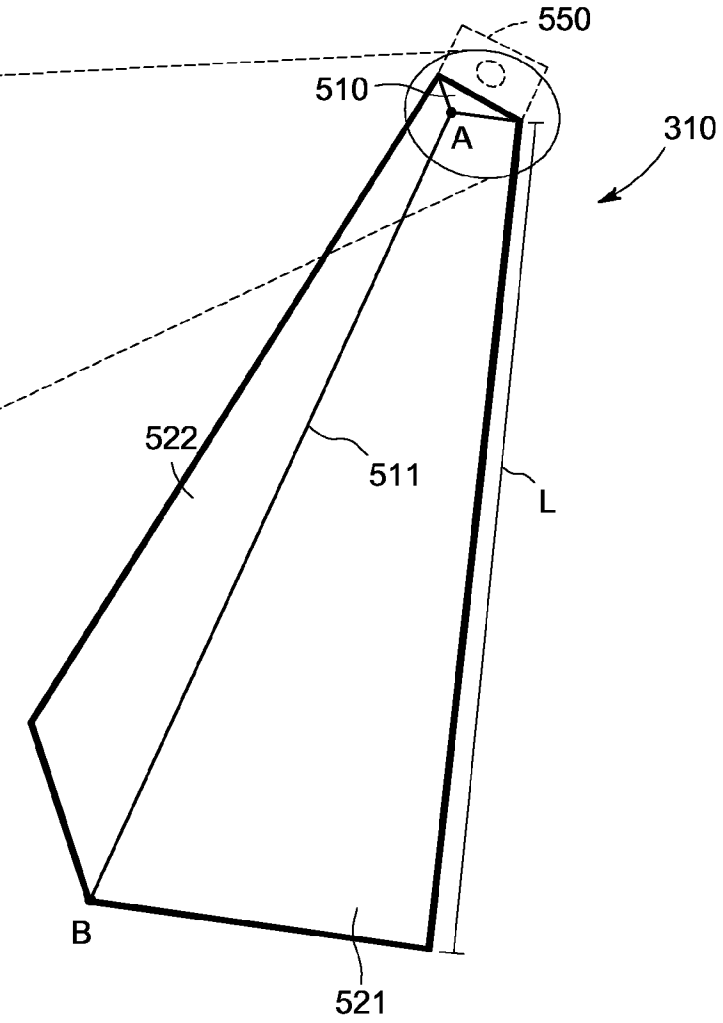
FIG. 5 is an exterior perspective view of a shield in accordance with one embodiment.
Figure 6:
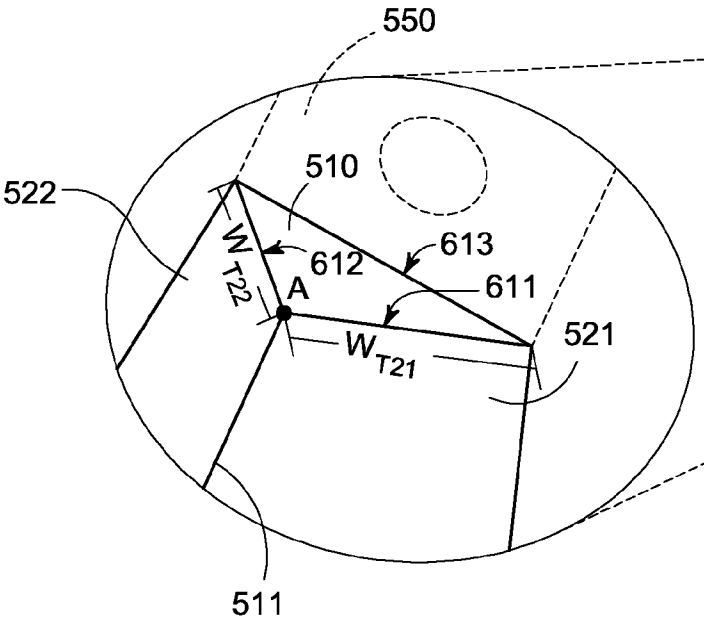
FIG. 6 is an enlarged view of a portion of the shield of FIG. 5.
Figure 11:
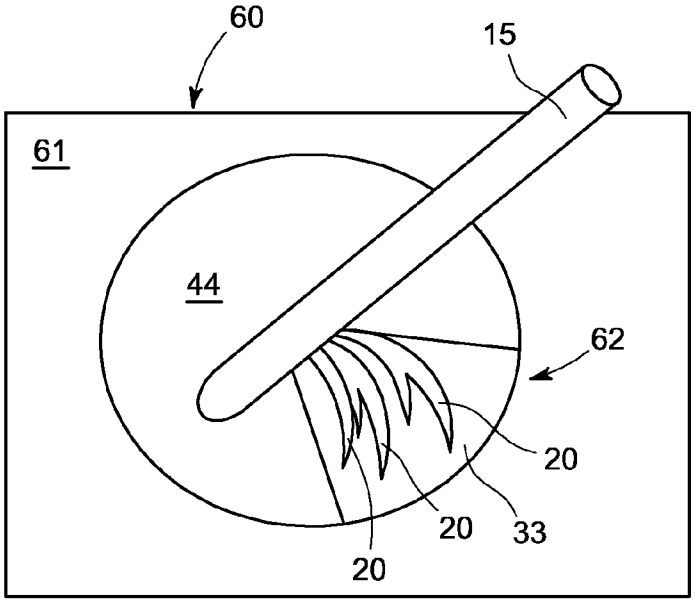
FIG. 11 (PRIOR ART)
FIGS. 10 and 11 illustrate views of a conventional ice dispensing assembly.
Figure 10:
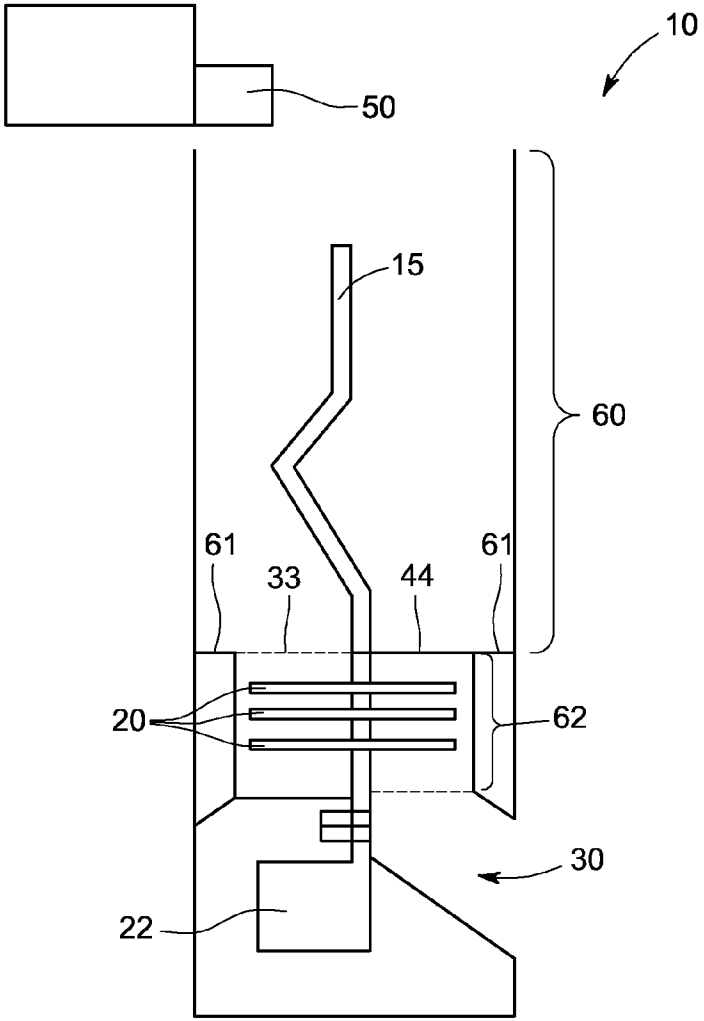
FIG. 10 (PRIOR ART)

FIGS. 5 and 6 respectively show a perspective view and enlarged partial perspective view of shield 310 in accordance with an embodiment of the present invention. Shield 310 comprises a top triangular member 510 and trapezoidal side members 521, 522. The trapezoidal side members 521, 522 are mounted on, attached to, coupled with, and/or integrally formed with top triangular member 510. The trapezoidal side members 521, 522 increase in width downwardly along the length L of the shield 310. Turning to FIG. 6, the length of lateral edge 611 of top triangular member 510 is approximately equal to the width $w_{T21}$ of the top edge of trapezoidal side member 521. Similarly, the length of lateral edge 612 of top triangular member 510 is approximately equal to the width $w_{T22}$ of the top edge of trapezoidal side member 522. Trapezoidal side members 521 and 522 and top triangular member 510 all meet at point A of shield 310. Turning back to FIG. 5, trapezoidal side members 521 and 522 continue from point A meeting along segment A-B along the length L of the shield 310. In other words, trapezoidal side members 521 and 522 share an edge along segment A-B. The shared edge (along segment A-B) is angular projection 511. In an embodiment, an optional support member 550 is attached to at least the base edge 613 (FIG. 6) of top triangular member 510. In this embodiment, a fastener and/or adhesive could be coupled with the support member 550 to attach the shield 310 to the inside of ice bucket 260. If shield 310 is implemented in an ice bucket 260 in accordance with the embodiment illustrated in FIG. 4A, base edge 613 may optionally be curved to substantially match the curvature of ice bucket 260. In other words, in an embodiment, base edge 613 fits flush with the inner circular wall of ice bucket 260 to prevent ice from catching between shield 310 and the wall 261 (FIG. 3) of ice bucket 260.

FIG. 7 shows a perspective view of the inside of an exemplary shield 310 in accordance with FIGS. 5 and 6. At least one of edges 613, 711, and 712 is attached to, mounted on, removably coupled with, and/or integrally formed with an inside wall of ice bucket 260. Again, if shield 310 is implemented in an ice bucket 260 in accordance with the embodiment illustrated in FIG. 4A, base edge 613 may optionally be curved to substantially match the curvature of ice bucket 260. In other words, in an embodiment, base edge 613 fits flush with the inner circular wall of ice bucket 260 to prevent ice from catching between shield 310 and the wall 261 (FIG. 3) of ice bucket 260. In another embodiment, a back member 720 (an exemplary bottom edge of which is shown in phantom) may connect with the trapezoidal side members 521, 522 along edges 711 and 712, respectively, and may also connect with the top triangular member 510 along base edge 613. In that case, at least a portion of trapezoidal member 720 is attached to, mounted on, removably coupled with, and/or integrally formed with an inside wall of ice bucket 260. If shield 310 is implemented in an ice bucket 260 in accordance with the embodiment illustrated in FIG. 4A, the shape of back member 720 may optionally be curved along its width to substantially match the curvature of ice bucket 260. In other words, in an embodiment, back member 720 fits flush with the inner circular wall of ice bucket 260 to prevent ice from catching between shield 310 and the wall 261 (FIG. 3) of ice bucket 260.

Trapezoidal side members 521 and 522 meet along angular projection 511 at an interior angle x. The interior angle x at which trapezoidal side members 521 and 522 meet at point B and along angular projection 511 may vary depending on the shape of opening 335. In an embodiment, the interior angle x is at least large enough so that shield 310 covers the area of opening 335. For example, in an embodiment where stationary plate 345 is circular and opening 335 comprises about 20% of that circle, angle x may be at least 72 degrees. Preferably, the slopes of trapezoidal side members 521 and 522 are steep enough to prevent ice cubes from catching on shield 310. In other words, the slopes of trapezoidal side members 521 and 522 are steep enough so that ice cubes that hit shield 310 can slide down the surfaces of the trapezoidal side members 521, 522 and can effectively fill ice bucket 260.

In the embodiment of FIG. 7, shield 310 comprises base member 730. Base member 730 is attached to the bottom edge of at least one of the trapezoidal side members 521, 522. Base member 730 serves to couple shield 310 with ice making assembly 300 via shaft 328. In that embodiment, shaft 328 may fit into an opening 735 formed in base member 730. If the portion of shaft 328 that fits into opening 735 is rotatable, base member 730, and therefore, shield 310 is stationary relative to that portion of shaft 328 (FIG. 3) when that portion of shaft 328 rotates. The shape and size of base member 730 is not limited to the embodiment illustrated in FIG. 7. For example, base member may be larger and extend fully along the bottom edges of trapezoidal side members 521 and 522. If shield 310 is implemented in an ice bucket 260 in accordance with the embodiment illustrated in FIG. 4A, the shape of base member 730 may optionally be curved along its edge 731 to substantially match the curvature of ice bucket 260. In other words, base member 730 fits flush with the inner circular wall of ice bucket 260 to prevent ice from catching between shield 310 and the wall 261 (FIG. 3) of ice bucket 260. Alternatively, the base member 730 may be smaller to the point where it does not exist at all.

In the embodiment illustrated in FIG. 7, the substrate that forms shield 310 is hollow. However, in other embodiments, shield 310 could alternatively be a solid substrate. Non-limiting examples of a substrate that could form shield 310 include but are not limited to plastic and/or metal. Although FIGS. 3, 4A, 4B, 5, 6, 7, 8, and 9 illustrate shields with certain shapes, shield 310 may be alternatively shaped as long as shield 310 has at least one side member 315 and is configured to cover at least the area of opening 335 to prevent ice cubes from falling directly from ice maker 250 into ice chute 330. The combination of the shield 310 with ice bucket 260 allows clumped ice to fall downwards by gravity into ice crushing region 265 without getting caught on horizontal surfaces, such as those found in conventional ice dispensing assemblies. For at least these reasons, shield 310 provides a means for clumped ice to fall into the ice crushing region 265 without the use of an auger.

While the invention has been described in terms of various specific embodiments, those skilled in the art will recognize that the invention can be practiced with modification within the spirit and scope of the claims. For example, features of various embodiments/variations can be combined. Thus, while there have shown, described and pointed out fundamental novel features of the invention as applied to various specific embodiments thereof, it will be understood that various omissions, substitutions and changes in the form and details of the devices illustrated and in their operation, may be made by those skilled in the art without departing from the spirit of the invention. For example, it is expressly intended that all combinations of those elements which perform substantially the same function in substantially the same way to achieve the same results be within the scope of the invention. It is the intention, therefore, that embodiments of the invention be limited only as indicated by the scope of the claims appended hereto.

What is claimed is:

1. An ice dispensing assembly, comprising:
a vertical drive shaft;
rotatable blades coupled to the drive shaft;
a stationary plate with an opening formed therein;
an ice bucket comprising at least one side wall that defines an inner surface of the ice bucket; and
a shield disposed within the ice bucket, the shield comprising at least one side member, the at least one side member increasing in width along its length downwardly from a top of the shield,
wherein the at least one side member is directly coupled to the inner surface of the inner bucket, wherein the shield is positioned directly over the opening and is sufficient to cover at least an area of the opening, and wherein the rotatable blades are disposed below the shield and above the stationary plate; and
wherein a length of the rotatable blades is slightly less than or equal to a diameter of the ice bucket.

2. The ice dispensing assembly of claim 1, wherein:
the at least one side wall is substantially straight.

3. The ice dispensing assembly of claim 1, wherein:
the inner surface of the ice bucket is cylindrical.

4. The ice dispensing assembly of claim 1, wherein:
the ice bucket comprises an ice crushing region, the ice crushing region comprising crusher blades and the rotatable blades,
wherein the ice crushing region is disposed below the shield and above the stationary plate.

5. The ice dispensing assembly of claim 4, wherein:
the stationary plate serves as a portion of a bottom surface of the ice bucket.

6. The ice dispensing assembly of claim 1, further comprising:
a motor.

7. An ice dispensing assembly of claim 1, wherein the shield comprises:
at least two side members, wherein the at least two side members increase in width along their length downwardly from a top of the shield, and wherein two of the at least two side members share an edge along a length of the side members and meet at an interior angle.

8. The ice dispensing assembly of claim 7, wherein: the opening formed in the stationary plate has an area, and wherein the interior angle is large enough so that the shield is configured to cover at least the area of the opening.

9. A cooling compartment, comprising:
an ice bucket comprising at least one side wall that defines an inner surface of the ice bucket:
a vertical drive shaft;
rotatable blades coupled to the drive shaft wherein a length of the rotatable blades is slightly less than or equal to a diameter of the ice bucket;
an ice chute;
an opening leading to the ice chute; and
a shield, comprising:
at least one side member, the at least one side member increasing in width along its length downwardly from a top of the shield,
wherein the at least one side member is directly coupled to the inner surface of the ice bucket,
wherein
the shield is positioned directly over the opening, and wherein the rotatable blades are disposed in between the shield and the stationary plate.

10. The ice dispensing assembly of claim 7, wherein the at least two side members are triangular in shape.

11. The ice dispensing assembly of claim 7, wherein the at least two side members are trapezoidal in shape.

12. The ice dispensing assembly of claim 11, wherein the shield further comprises:
a top triangular member, the top triangular member sharing an edge with at least one of the at least two trapezoidal side members.

13. The ice dispensing assembly of claim 12, wherein a length of a lateral edge of the top triangular member is approximately equal to a width of a top edge of one of the at least two trapezoidal side members.

14. The ice dispensing assembly of claim 1 wherein the at least one side member comprises at least one curved side member.

15. The ice dispensing assembly of claim 1, wherein the shield further comprises:
a top member, the top member sharing an edge with the at least one side member.

16. The ice dispensing assembly of claim 15, wherein the top member has at least one curved edge.

17. The ice dispensing assembly of claim 1, wherein the shield further comprises:
a base member.

18. The ice dispensing assembly of claim 17, wherein:
the base member has an opening formed therein such that the vertical drive shaft fits into the opening.

* * * * *